United States Patent [19]

Thompson et al.

[11] 4,248,389

[45] Feb. 3, 1981

[54] CONTAINER SORTING AND HANDLING SYSTEM

[76] Inventors: Fremont G. Thompson, 6740 Commerce Rd., Orchard Lake, Mich. 48033; Lewis P. Vogel, 6375 Werkner Rd., Chelsea, Mich. 48118; Eugene R. Wagner, 663 Thayer, Northville, Mich. 48167

[21] Appl. No.: 3,349

[22] Filed: Jan. 15, 1979

[51] Int. Cl.[3] ..... B07C 5/00

[52] U.S. Cl. ..... 241/101.5; 209/524; 209/564; 209/583; 209/538; 209/546; 209/911; 250/223 B

[58] Field of Search ..... 209/524, 563, 564, 565, 209/566, 583, 538, 701, 523, 911, 546; 250/223 B; 241/101.5

[56] References Cited

U.S. PATENT DOCUMENTS

| | | | |
|---|---|---|---|
| 3,532,215 | 10/1970 | Davidson | 209/911 X |
| 3,609,306 | 9/1971 | Langley | 209/583 X |
| 3,639,728 | 2/1972 | Helfand | 209/583 X |
| 3,645,391 | 2/1972 | Hirakawa | 209/583 X |
| 3,963,918 | 6/1976 | Jensen | 250/223 B |
| 3,991,883 | 11/1976 | Hobler et al. | 209/524 |
| 4,074,130 | 2/1978 | Messman | 250/223 B X |

*Primary Examiner*—Allen N. Knowles
*Attorney, Agent, or Firm*—Gifford, VanOphem, Sheridan & Sprinkle

[57] ABSTRACT

A novel container sorting and handling system is provided for sorting a plurality of diverse types of containers into preselected types for either reuse, reclamation or disposal depending upon the type of container. The sorting system comprises a housing having a sorting station defined therein and an infeed conveyor for sequentially and individually transporting containers to the sorting station. At the sorting station the individual containers are rotated by a roller in order to bring the UPC Code, bar code or other code on each container into alignment with an optical scanner at the sorting station. The optical scanner produces an output signal representative of the bar code and this is in turn fed to a computer which compares the signal from the optical scanner with a plurality of prestored values in the computer. As a result of this comparison, the computer generates an output signal representative of the type of container at the sorting station. This output signal from the computer in turn is fed to an indexing mechanism which transports the container in the sorting station to one of a plurality of outfeed conveyors whereby each outfeed conveyor transports a single type of container. The recyclable containers are crushed and/or shredded into a compact mass and transported to a salvage company and/or reclamation center. The computer also provides a signal to an output device which produces a tangible record via coin, receipt or token of the monetary value of the returnable containers processed by the system.

6 Claims, 3 Drawing Figures

CONTAINER SORTING AND HANDLING SYSTEM

BACKGROUND OF THE INVENTION

I. Field of the Invention

The present invention relates generally to sorting and handling devices and, more particularly, to a sorting device for separating a plurality of diverse types of containers into predetermined groups for reuse, reclamation or disposal.

II. Description of the Prior Art

There are a number of different types of containers and partcularly containers which contain consumable goods. Many types of containers, for example, heavy glass containers are suitable for reuse after cleaning. Many containers of this type conventionally carry a deposit which is refunded when the empty container is returned to the place of purchase.

Still other types of containers are unfit for reuse, such as paper containers, light glass containers and metallic cans. Nonrefillable containers are currently discarded for waste disposal even though these containers are constructed of material which can be reclaimed or recycled and thus have a monetary value. This is particularly true for metal cans in which the metal can be remelted and formed into a new can.

Virtually all of the food containers have a UPC, bar or other code imprinted on the container. The code is encoded by industry standards so that each different product, and thus the container, is assigned a specific code. These codes enable an optical scanner at a checkout counter to accurately and rapidly determine the type and price of the item as well as provide a convienient inventory control means. Such codes, however, have never heretofore been employed for sorting empty containers into their various different types.

The previously known method for stores and other retail centers for accepting, sorting and distributing containers returned by their customers has been unduly complex, time consuming and, therefore, expensive. In the current practice, a clerk must first identify each container and place it into a bin or other storage area. Then the clerk either manually pays the customer or gives him a slip so that the customer can be reimbursed by the retail center. When the bin is full, the clerk then must take it to a further sorting area in which the containers are sorted by brand and size and then placed into master containers which again not only is time consuming but also requires large storage areas in the store which could otherwise be put into productive use.

After the various containers have been separated into their own master bins, the driver-salesman for the distributor of that particular brand or product must then manually pick up the master containers for his own company and transport the empty containers to the bottling plant without any benefit of size reduction. At the bottling plant the containers are again manually sorted to remove paper, plastic, disposable glass and metal containers. These removed products are then sent to a salvage company which crushes the material for sale as recyled material.

This previously known method for sorting and recycling containers is disadvantageous in several different respects. First, the containers must be manually sorted on at least three different occasions which involves not only extremely high overall labor costs but also requires a separate work area and storage area for each of these sorting operations. Such work and storage areas could otherwise be employed for more productive, i.e. profitable, purposes if the required sorting operations and storage could be eliminated.

A still further disadvantage of this previously known method for handling the returned containers is that the disposable containers are maintained in their original size and shape when they are transported both to the bottling plant and to the salvage company where the containers are finally crushed and reduced in size for efficient handling. Consequently, by this prior procedure the bulky and lightweight containers must be inefficiently and expensively handled and transported from both the store and the bottling company, oftentimes requiring several different trips due to the overall bulk of the empty containers. This prior procedure also requires high fuel costs when transporting the empty containers.

A still further disadvantage of this previously known procedure is that the clerk must not only manually initially sort the containers but must also manually reimburse the customer for the containers returned to the store. Consequently, as in all manual operations, errors in both sorting operation and the reimbursement to the customer occur and must usually be assumed by the store as a loss. Moreover, during the initial sorting, the clerk will oftentimes inadvertently accept containers for a brand and/or size of product which the store itself does not carry for sale. In this case the store must again accept as a loss the money which has been paid to the customer for such containers.

SUMMARY OF THE PRESENT INVENTION

The present invention provides a novel container sorting system which reads the bar code on empty containers and utilizes this information to separate the containers into their various diverse types. Moreover, the system of the present invention includes means for automatically computing and providing a tangible record of the proper reimbursement to the customer and also includes means for compacting or crushing the containers for easy handling.

In brief, the container sorting system according to the present invention comprises a housing having a sorting station formed therein. An infeed conveyor means sequentially and individually transports containers to the so rting station.

An optical scanner is associated with the sorting station while a turntable rotates the container at the sorting station in order to bring the container bar code, UPC Code or other container code into alignment with the optical scanner. Upon reading the bar code, the optical scanner produces an output signal representative of the bar code on the container.

The output from the optical scanner in turn in connected as an input signal to a computer which compares the input signal from the scanner with prestored container bar code values. Upon identification of the container at the sorting station, the computer generates an output signal of the type of container at the sorting station. In the event the brand or size of the container is not carried by the store, the computer actuates an ejector means which returns the container to the customer.

The output signal from the computer is fed to an index means which transports the container from the sorting station and to one of a plurality of different outfeed conveyors so that only one type of container is transported by each outfeed conveyor. In this fashion the metallic containers are separated from the other containers for reclamation and recycling, the refillable containers are separated from the other containers for cleaning and reuse while the remaining light glass and paper containers are prepared for disposal.

The computer also generates a further output signal which is fed to a computer controlled printer which prints a record of the number and types of containers fed to the sorting system in addition to the cash value of the returned containers. Preferably, the printer also produces a record of the returned containers for use by the owner of the system with the bottler or vendor. This written record is removed by the customer and taken to the proper place for reimbursement of the value of the returned containers. Alternately, the computer can feed this output signal to a device which returns a coin or token to the customer. Moreover, since brands and/or sizes of containers not carried by the store are ejected and returned to the customer, this eliminates the inadvertent acceptance of noncarried containers by the clerk as is common with the previously known bottle sorting system.

The present invention further includes means for compacting, crushing and/or shredding the containers, once separated into their various container types into a compact mass for efficient handling. The crushed and/or shredded containers are then loaded by conveyors into self-emptying dumpable containers. Consequently, the only handling of the containers required when using the present invention involves transporting the compacted and/or shredded containers directly to a salvage company and even this handling can be achieved by a self-loading garbage truck.

As will become hereinafter more clearly apparent, the present invention provides a means which reduces not only labor costs for the store but also the storage areas and losses heretofore assumed by the store. The present invention further eliminates both the handling and trucking of the uncompacted containers by the driver-salesman for the various container distributors but also the handling and sorting of the containers at the bottling plant. In addition, the present invention further eliminates the transportation of the uncompacted containers from the bottling company and to the salvage company and further eliminates the need for crushing the containers at the salvage company.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
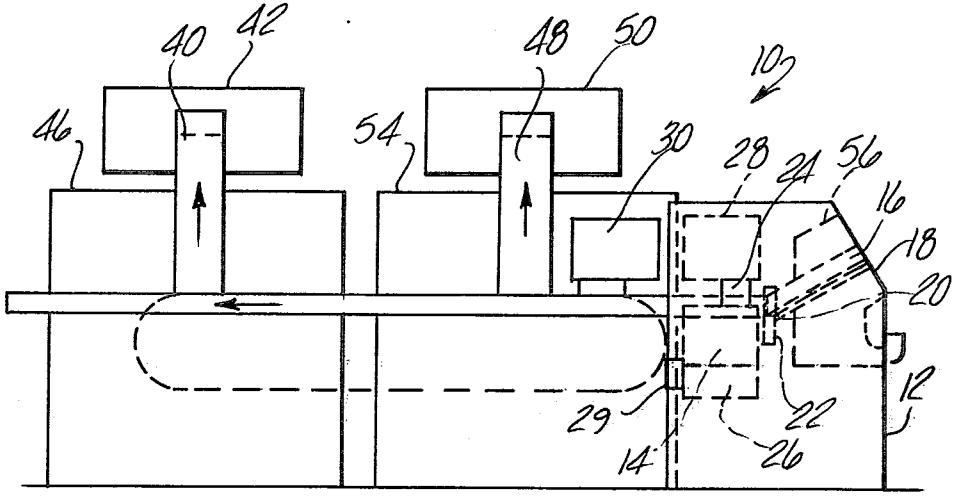
FIG. 1 is a side view illustrating the sorting system according to the present invention.
Figure 2:
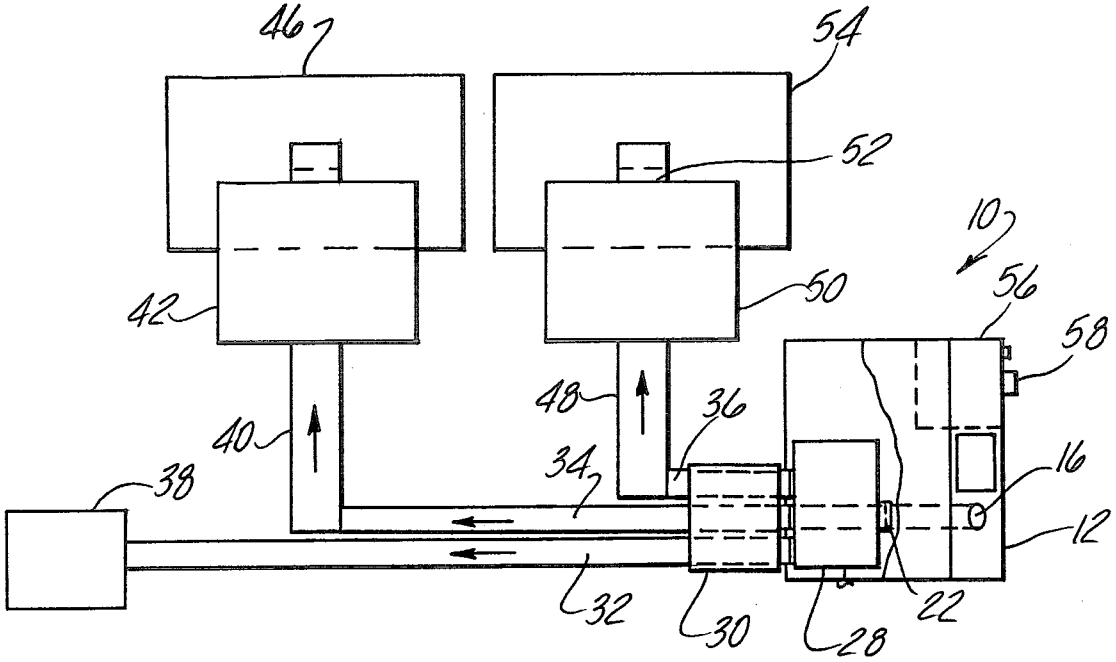
FIG. 2 is a top view illustrating the sorting system according to the present invention.

With reference first to FIGS. 1 and 2, the sorting system 10 according to the present invention is thereshown and comprises a housing 12 having a sorting station or chamber 14 formed therein. An infeed conveyor or chute 16 is open at one end 18 exteriorly of the housing 12 and, at its other end, is open to the sorting station 14. A stop gate 22, however, is operatively positioned at the inner end 20 of the infeed conveyor 16 tc permit the entry of only a single container into the sorting station 14 at any given time. Once the container is removed from the sorting station 14 in a fashion which will be subsequently described in greater detail, the stop gate 22 is actuated or opened to permit the next container on the infeed conveyor 16 to enter into the sorting station 14.

An optical scanner 24 is also positioned within the housing 12 adjacent the sorting station 14 and is operatively connected with the sorting station 14 to read the UPC Code, bar code or other code imprinted upon the container. In order to bring the container code on the container into alignment with the optical scanner 24, a roller means 26 positioned under the container rotates the container within the sorting station 14 so that the container code sweeps past and is read by the optical scanner 24. Since the chute 16 is circular and slopes upwardly, the container will automatically lay on its side against the roller means.

Upon reading the container code, the optical scanner 24 generates an output signal representative of the bar code to a computer 28 also contained within the housing 12. The computer 28 is programmed to compare the input signal from the optical scanner 24 with a plurality of container code values prestored in the computer's memory banks. Upon identification of a proper container code by the computer 28, the computer 28 generates an output signal representative of the type of container within the sorting station 14 to an indexing means 30.

In the event that the container code is not identified, indicative that the particular brand is not carried by the store, the computer 28 generates an output signal to an ejector means 29 which returns the container to the customer.

Upon receipt of the output signal from the computer 28, the indexing means 30 removes the container from the sorting station 14 and places the container on one of the three outfeed conveyors 32, 34 or 36. The indexing means 30 can comprise any conventional construction such as a tilt toy type, a belt conveyor indexer, a pusher arm indexer or the like so that a further description is unnecessary. It will be understood, of course, that the three conveyors 32, 34 and 36 illustrated in the drawing are exemplary only and that more outfeed conveyors can be employed as desired while remaining in the scope of the invention. In any event, as a result of the output signal from the computer 28, only a single type of container is placed on each outfeed conveyor 32, 34 or 36.

For example, as shown in the drawing, the outfeed conveyor 32 is used to convey refillable bottles from the indexing means 30 and to a further sorting station 38 where the containers are arranged into their various types and brands. Similarly, the outfeed conveyor 34 is used to transport disposable glass bottles and paper containers while the outfeed conveyor 36 transports only metal cans from the indexing means 30.

Figure 3:
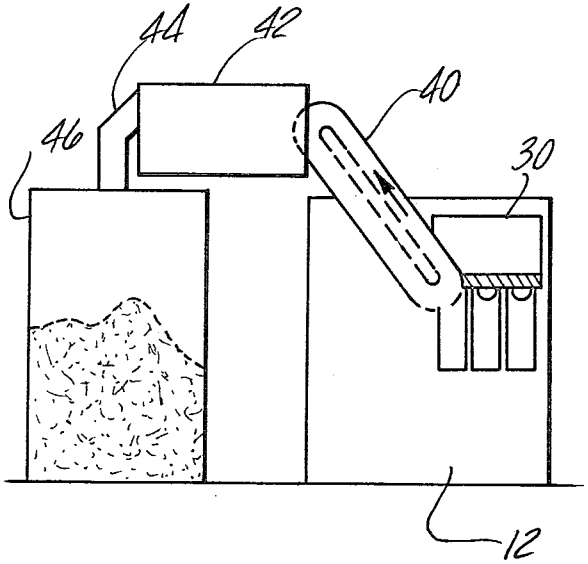
FIG. 3 is an end view illustrating the sorting system according to the present invention.

With reference now to FIGS. 2 and 3, the outfeed conveyor 34 transports the light glass bottles and paper containers to an elevating conveyor 40 which transports these containers to the inlet of a shredder or a crushing mechanism 42. The output 44 from the shredder or crusher mechanism 42 is open to a self-emptying dumpable container 46 which is periodically emptied as required and taken to a salvage company.

The conveyor 36 likewise transports the metal cans to a further elevating conveyor 48 which is open to the inlet of a crusher or shredder mechanism 50. The outlet 52 from the crusher or shredding mechanism 50 is also open to a further container 54, like the container 46, and the contents of the container 54 are periodically taken to a salvage company and/or metal reclamation center where the now crushed and/or shredded metal cans are melted and reformed into new metal products.

With reference now to FIGS. 1 and 2 a recording unit 56 is also preferably contained within the housing 22. The computer 28 produces an output signal to the recording device 56 which in turn provides a written record 58 of the containers inserted into the sorting system 10. The record 58 would, for example, be indicative of the total deposits on the returnable bottles inserted into the infeed conveyor 16 and likewise could indicate the number and/or monetary value of the recyclable containers inserted into the conveyor 16. The user then can simply take the record 58 to the appropriate place for reimbursement. Alternatively, a coin or token would be returned to the customer in response to the output signal from computer 28.

From the foregoing it can be seen that the apparatus according to the present invention provides a novel means for not only automatically sorting diverse containers into their various diverse types but also for providing an accurate written record of the containers inserted into the infeed chute. Moreover, after insertion of the containers into the infeed chute the containers are automatically separated and, when appropriate, crushed and/or shredded into a compact mass and placed into a self-emptying receptacle. Moreover, all of this is done in a minimum area requirement and without any labor costs whatsoever since the machine is fully automated.

The device according to the present invention is further advantageous in that only the compacted and/or shredded containers need to be transported to either the salvage company and/or reclamation center which greatly minimizes handling, transportation and storage cost. All labor costs associated with manually sorting the containers is, or course, totally eliminated.

Having described my invention, however, many modifications thereto will become apparent to those skilled in the art to which it pertains without deviation from the spirit of the invention as defined by the scope of the appended claims.

We claim:

1. A system for sorting diverse types of containers, each container having a code imprinted thereon, said system comprising:

a housing having a sorting station formed therein;

an elongated feed chute formed in the housing, said feed chute having one end open exteriorly of the housing and its other end open to the sorting station so that a user can manually insert diverse containers into the feed chute and to the sorting station;

stop gate means operatively connected with said feed chute for permitting only a single container to enter the sorting station at a particular time, said stop gate means being positioned adjacent the sorting station so that a plurality of containers can be simultaneously positioned in the feed chute;

at least two conveying means for transporting containers from said sorting station, each conveying means being adapted to transport a predetermined type of diverse container;

means at said sorting station for reading the code on a container at the sorting station and for producing an output signal representative of the code;

means responsive to said reading means output signal for identifying the type of container;

indexing means responsive to said identifying means for displacing a container from the sorting station and directly to one of said conveying means in dependence upon the type of the container; and ejector means responsive to said identifying means for ejecting a container to the outside of said housing when the container is none of said predetermined type of diverse container.

2. The invention as defined in claim 1 wherein said reading means further comprises an optical scanner operatively connected with said sorting station, and means for rotating said containers at said sorting station to thereby bring said code into alignment with said scanner.

3. The invention as defined in claim 1 wherein said identifying means comprises a computer programmed to receive the reading means output as an input signal, programmed to compare said input signal with a plurality of code values accessible to said computer, and programmed to generate an output signal to the indexing means as a result of said comparison.

4. The invention as defined in claim 1 and further comprising means responsive to said identifying means for producing a tangible printed record of the types of containers identified by said identifying means.

5. The invention as defined in claim 1 and including means associated with at least one of said conveying means for crushing said containers on said last mentioned conveying means.

6. The invention as defined in claim 1 and including means associated with at least one of said conveying means for shredding said containers on said last mentioned conveying means.

* * * * *

UNITED STATES PATENT AND TRADEMARK OFFICE

CERTIFICATE OF CORRECTION

PATENT NO. : 4,248,389

DATED : February 3, 1981

INVENTOR(S) : Fremont G. Thompson et al.

It is certified that error appears in the above—identified patent and that said Letters Patent is hereby corrected as shown below:

Column 2, line 47, "so rting" should read -- sorting --.

Column 2, line 55, "in", second occurrence, should read -- is --.

Column 4, line 56, "where" should read -- whereat --.

Signed and Sealed this

*Twenty-third* Day of *June 1981*

[SEAL]

*Attest:*

RENE D. TEGTMEYER

*Attesting Officer* *Acting Commissioner of Patents and Trademarks*